US005718424A

United States Patent [19]

Nakatani et al.

[11] Patent Number: 5,718,424

[45] Date of Patent: Feb. 17, 1998

[54] SHEET FEEDING DEVICE HAVING A SEPARATING AND PRESTRESSING DEVICE

[75] Inventors: Noboru Nakatani, Rennes; Alexandre Dodge, Pace; Stéphane Michel, Montfort sur Meu; Christophe Truffaut, Rennes; Marie-Hélène Froger, Chateaugiron, all of France

[73] Assignee: Canon Kabushiki Kaisha, Tokyo, Japan

[21] Appl. No.: 591,696

[22] Filed: Jan. 25, 1996

[30] Foreign Application Priority Data

Feb. 1, 1995 [FR] France ..... 95 01163

[51] Int. Cl.[6] ..... B65H 3/52

[52] U.S. Cl. ..... 271/121; 271/124

[58] Field of Search ..... 271/121, 124

[56] References Cited

U.S. PATENT DOCUMENTS 4,887,806 12/1989 Tanaka et al. .
5,102,115 4/1992 Takamizawa et al. ..... 271/121

FOREIGN PATENT DOCUMENTS 0464851 1/1992 European Pat. Off. .
2588536 4/1987 France .
281835 3/1990 Japan ..... 271/121
3249038 11/1991 Japan ..... 271/121

*Primary Examiner*—David H. Bollinger
*Attorney, Agent, or Firm*—Fitzpatrick, Cella, Harper & Scinto

[57] ABSTRACT

A feeding device transfers, one by one, sheets from a pile (12) to a processing device having a storage area for the pile of sheets, a drive roller (201) in contact with a sheet disposed at one end of the pile, a separating and prestressing device (203, 210) disposed opposite the roller, the separating and prestressing device including a friction device (203) generating, on the sheet, a friction opposite to the direction in which the sheet is driven. The separating and prestressing device (203, 210) also has a movable support (205) and a lever (211), the support (205) bearing the friction device, whilst the lever has at least one lateral prestressing arm (341), and an elastic unit (214) acting on the lever (211) in order to bias the surface towards the roller (201).

18 Claims, 7 Drawing Sheets

SHEET FEEDING DEVICE HAVING A SEPARATING AND PRESTRESSING DEVICE

Figure 1:
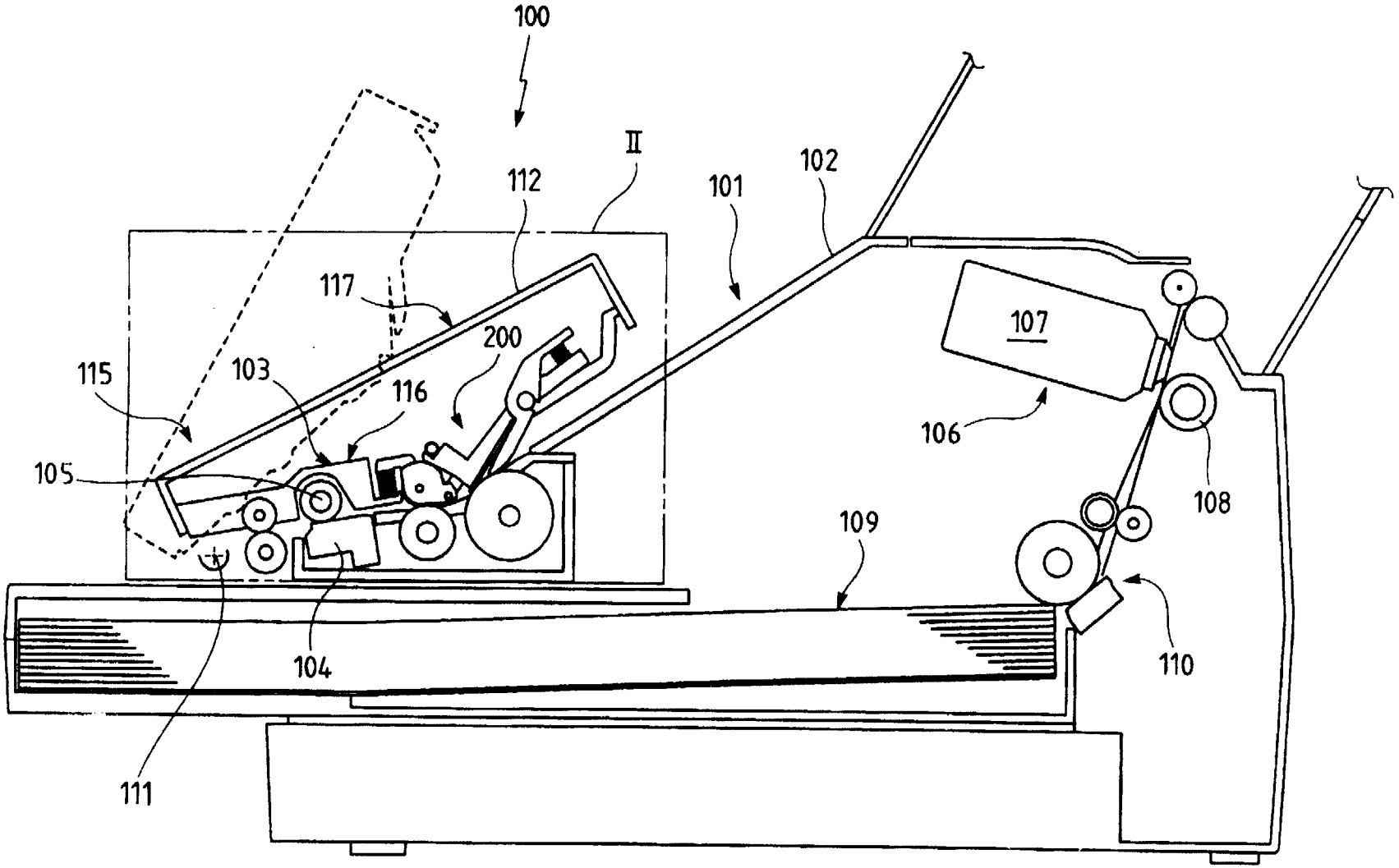

The present invention relates to a sheet feeding device designed to transfer, one by one, sheets forming part of a pile to a device for processing the said sheets.

The present invention essentially finds an application in facsimile machines, notably as a device for feeding documents to be sent. It also finds an application as a sheet feeding device for a printing device, whether it be a printer, a photocopier or a facsimile machine. It can, in a general manner, find an application in the field of office automation, and other fields where it is necessary to transfer one by one the sheets forming part of a pile to a device for processing the said sheets.

The term "processing" is therefore to be regarded as encompassing:

- the reading or analysis of items of information carried by the sheets,
- the formation of images on the sheets, for example by printing, and
- more generally, any use or transformation of the sheets by the processing device.

The feeding device in accordance with the invention is of the type having a storage area for a pile of sheets, a device for separating the said sheets and a device for prestressing the pile of sheets.

The invention concerns, more particularly, a novel device for separating and prestressing sheets.

In general terms, the separation of the sheets in a feeding device of the aforementioned type is effected by a separating drive roller which is arranged so as to be in contact with the sheet on the bottom of the said pile of sheets, in cooperation with a friction device, adapted to generate on the said bottom sheet a friction whose direction is substantially opposite to the direction of driving of the sheet by means of the drive roller, the value of the friction force being determined, having regard to the rubbing exerted by the driver roller on this first sheet, so as to enable it to be driven while retaining the rest of the sheets in the pile. The drive roller and the friction device thus separate this first sheet from the rest of the pile.

Preferably, the friction device generally consists of a rubber blade bearing upon the drive roller. In this case, particularly if the pile is likely to contain more than a dozen sheets, and as climatic conditions can vary, it is sometimes necessary to add to the said rubber blade a prestressing device designed to pack the pile of sheets, so as to ensure that there is contact between the bottom sheet and the drive roller.

The objective of the present invention is, in general terms:

- to enable the first sheet or bottom sheet of piles of sheets, which may include several tens thereof, to be separated, whether this pile is full or virtually empty,
- to enable this separation even though different types of paper, as regards their thickness or rigidity for example, may be used,
- and this under variable climatic conditions with respect to ambient temperature or humidity.

The inventors, faced with this technical problem, in fact observed that, in the prior art, no device exists for separating and prestressing sheets, able to include at once a relatively simple, and therefore inexpensive structure, while being able to process piles of sheets including a large number thereof, for example more than ten.

In the prior art, several separation and prestressing devices exist.

For example in the document U.S. 4,887,806, a separation and prestressing device is described which has a separating roller surmounted by a rubber friction blade, arranged on the central part of the said roller. The friction blade is surmounted by an E-shaped three-arm spring, whose central arm exerts pressure on the rubber blade, to bring the latter back into contact with the separating roller, while the two lateral blades exert pressure on the pile of sheets.

The inventors observed that this device does not give satisfaction, in so far as it does not enable a pile of sheets including several tens thereof to be processed, for several reasons outlined below.

Firstly, if such a device is to be used for processing piles containing about ten sheets, or indeed more, it is necessary to arrange the lateral arms of the said spring in order for the latter to exert a force that is such that, when for example the pile contains a maximum number of sheets, a predetermined pressure exists between the sheet at the bottom of the pile and the roller. As the pile diminishes, the pressure on the bottom sheet increases, to the point where the pressure existing between the bottom sheet and the sheets above it generates such great frictional forces between them that several sheets risk being driven by the drive roller. A detrimental multiple feeding may then result therefrom. This is because the friction force generated by the rubber blade may be insufficient for separating the bottom sheet from the second sheet in the pile.

Secondly, in so far as the inventors wished to retain a drive roller with a predetermined, relatively small diameter, it was observed that, in order to be able to provide the space required for housing more than ten sheets (thirty, for example), it was necessary to increase the angle formed by the rubber blade with the surface of the roller, thereby reducing the separation effect of the said blade.

Moreover, it would have been necessary to move back the bearing area of the lateral prestressing blades, which would have moved back the active area of the prestressing force on the sheet at the bottom of the pile. This would have been unfavourable since the ideal active area of prestressing on the bottom sheet is its area tangential to the roller, and moving back the active area reduces the driving effect of the roller on the sheet.

Thirdly and finally, as in the device described in the document U.S. 4,887 806 the prestressing force is that exerted by the two lateral arms of the single spring, it is difficult to adjust the tension of these in such a way that they exert an identical pressure on the sheets. A difference in pressure can lead to the bottom sheet being fed slightly crooked, which is also detrimental.

The present invention aims in particular to overcome these drawbacks.

To this end, it proposes, according to a first aspect, a sheet feeding device designed to transfer, one by one, sheets forming part of a pile to a processing device for the said sheets, having a temporary storage area for the pile of sheets, a drive roller arranged so as to be in contact with a first sheet disposed at one of the ends of the pile, a separating and prestressing device disposed opposite the drive roller, the separating and prestressing device including a friction device generating, at least on the said first sheet, friction in a direction substantially opposite to the direction in which the said first sheet is driven, characterised in that the separating and prestressing device also has a movable support and a movable bearing means, the support bearing the friction device, whilst the movable bearing means has at least one prestressing surface, and an elastic means acting on the movable bearing means in order to bias the said prestressing surface towards the drive roller.

According to a second aspect, the present invention proposes, in order to overcome the aforementioned drawbacks, a feeding device designed to transfer, one by one, sheets forming part of a pile to a processing device for the said sheets, having a temporary storage area for the pile of sheets, a drive roller arranged so as to be in contact with a first sheet disposed at one of the ends of the pile, a separating and prestressing device disposed opposite the drive roller, the separating and prestressing device including a friction device generating, at least on the said first sheet, friction in a direction substantially opposite to the direction in which the said first sheet is driven, characterised in that the separating and prestressing device also has a movable support and a lever, the support bearing the friction device, whilst the lever has a pair of lateral prestressing arms, and an elastic means acting on the lever in order to bias the lateral arms towards the drive roller.

In a preferred embodiment, the friction device has a separating blade, advantageously made of rubber.

By means of these devices, the present invention overcomes the drawbacks cited above.

It will, moreover, be observed that the simple mechanical arrangement proposed by the present invention enables the prestressing force exerted at the first sheet (that is to say the one effectively active on the said first sheet) to be stabilized, and this despite any variation in the number of sheets in the pile of sheets, as the pile diminishes. In particular, an excessive force is avoided when only a few sheets remain in the pile.

This advantage is obtained by means of the simple mechanical structure, enabling the movable bearing means to have a long travel (or the lever to have long angular travel), while exerting on one or other of the latter an elastic force advantageously varying virtually linearly with the number of sheets.

The inventors thus consider that, if a device, such as the one described in the prior art outlined above, is required to process large piles of sheets (for example thirty), the force exerted by the blade on the pile of sheets is so great that the friction forces generated thereby between the sheets cause the risk of detrimental multiple feeding to increase. Conversely, also because of the increase in the friction forces between the various sheets, it is possible that, under certain conditions, the sheet on the bottom of the pile will remain "stuck" to the sheet above, the latter also being "stuck" to the following ones: in such a case, there is a risk of an absence of feeding, which is also detrimental.

On the other hand, the present invention, as defined briefly above, enables the number of sheets able to be processed by a feeding device, notably for a facsimile machine, to be increased, while limiting the risk of absence of feeding or multiple feeding.

In a preferred embodiment, the support and the lever pivot about a common axis.

Such a separation and prestressing device is not only considerably more compact than those in the prior art mentioned above, but also lighter and less expensive than the latter. It therefore makes it possible to produce a sheet processing device, for example a facsimile machine, that is itself more compact, or frees space for housing other components of the facsimile machine.

Furthermore, it also forms a single unit able to be mounted easily in the sheet processing device and therefore easily exchangeable.

Also advantageously, the movable bearing means (or the lateral prestressing arms in the case of the preferred embodiment) is arranged so as to act on the pile of sheets in the vicinity of the lateral ends of the drive roller and above the latter.

By means of this arrangement, cooperation between the drive roller and the movable bearing means (or the lateral prestressing arms) is improved.

This is because the inventors had occasion to observe that, the greater the prestressing action exerted in the vicinity of the centre of the drive roller, the higher the prestressing force needs to be, with the drawbacks that result therefrom. In fact, it has been observed that, in a general manner, the pile of sheets is in contact with the drive roller only in the vicinity of its ends, and not in the centre thereof, since the pile of sheets has a slightly arched shape above the drive roller, without there being, consequently, contact with the centre of the drive roller. Furthermore, the slightly arched nature of the pile of sheets generates tension forces therein, which require, in order to be overcome, a relatively higher prestressing force. These defects are aggravated when the number of sheets in the pile of sheets increases.

By virtue of the characteristic described above, these drawbacks are avoided, by arranging for the prestressing force to act in the vicinity of the ends of the roller, that is to say at the point where the contact between the roller and the pile of sheets is natural. Consequently, the need to increase the prestressing force is avoided.

Furthermore, in such an arrangement, the prestressing force, which is exerted through the pile of sheets on the ends of the roller, has the effect of substantially modifying the curvature thereof, owing to a relative flattening of this curvature. Consequently, the apparent radius increases, and the driving effect on the sheet on the bottom of the pile is the same as it would be if the latter were subjected to a roller having a substantially greater radius than that which it has in reality. This characteristic of the invention consequently increases the efficacy of the drive roller, and consequently the separating power of the separating device and therefore of the feeding device into which it is integrated.

In accordance with another characteristic of the invention, the said prestressing surface of the first aspect of the latter is rounded at the end making contact with the drive roller. Similarly, the prestressing arms of the second aspect of the invention each have a rounded prestressing surface at the end making contact with the drive roller.

By means of these arrangements, when a small number of sheets are processed by the feeding device, the latter are naturally gripped between the drive roller and the separating and prestressing device, without it being necessary to act substantially on the movable bearing means (or the lever) against the biasing force of the elastic means.

The present invention also proposes an image forming apparatus having a sheet feeding device as defined above.

Figure 2:
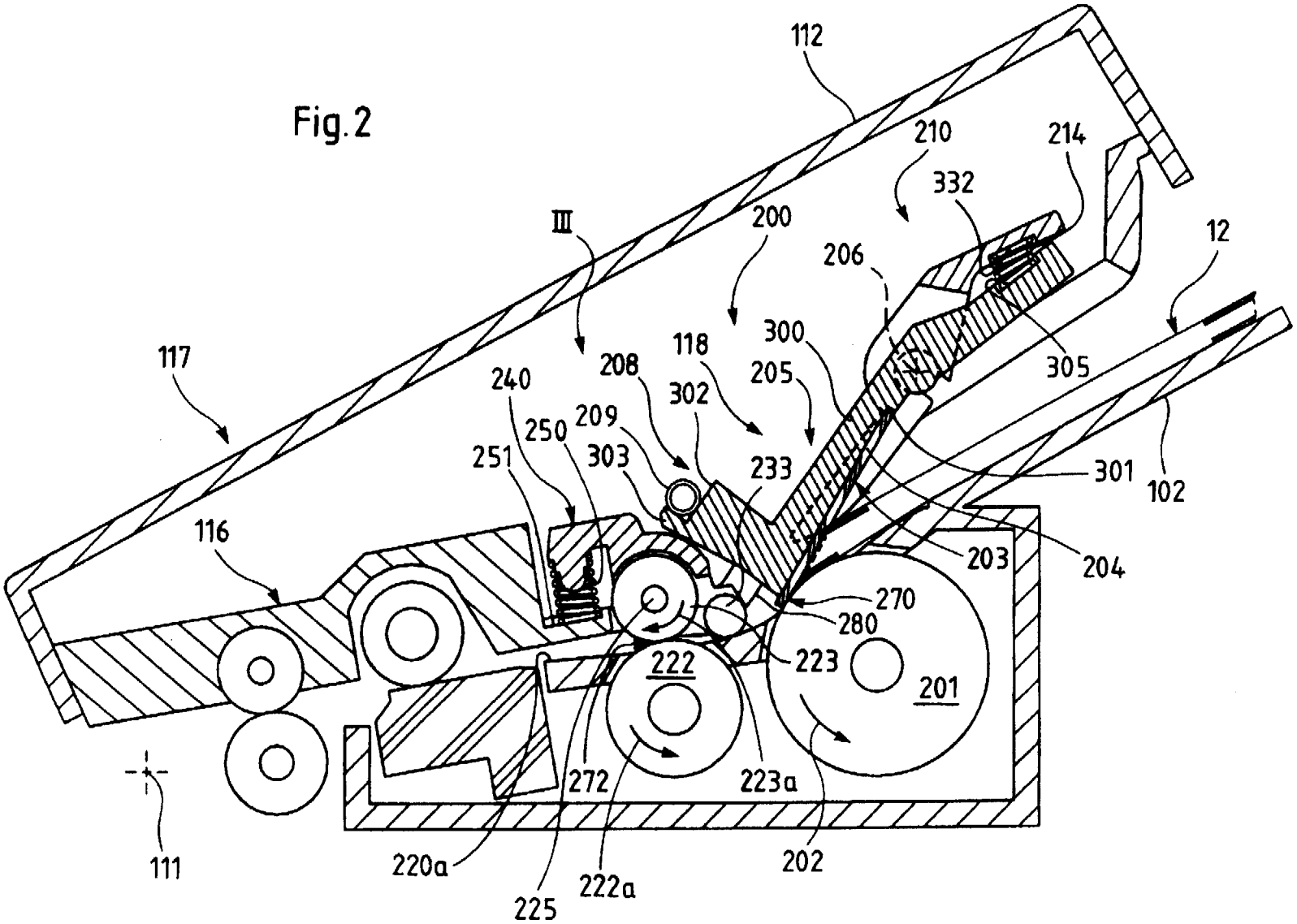
Figure 3:
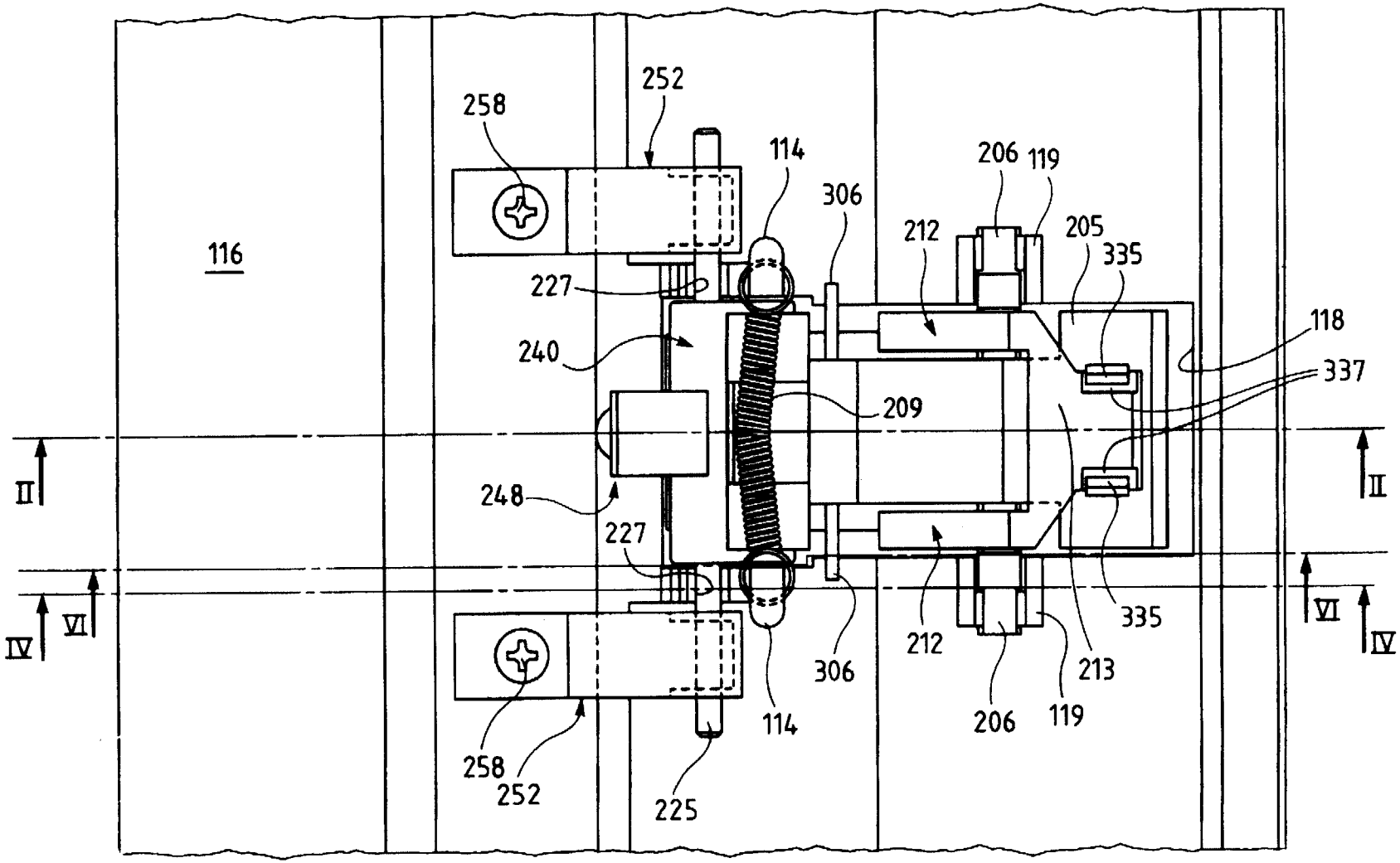
Figure 4:
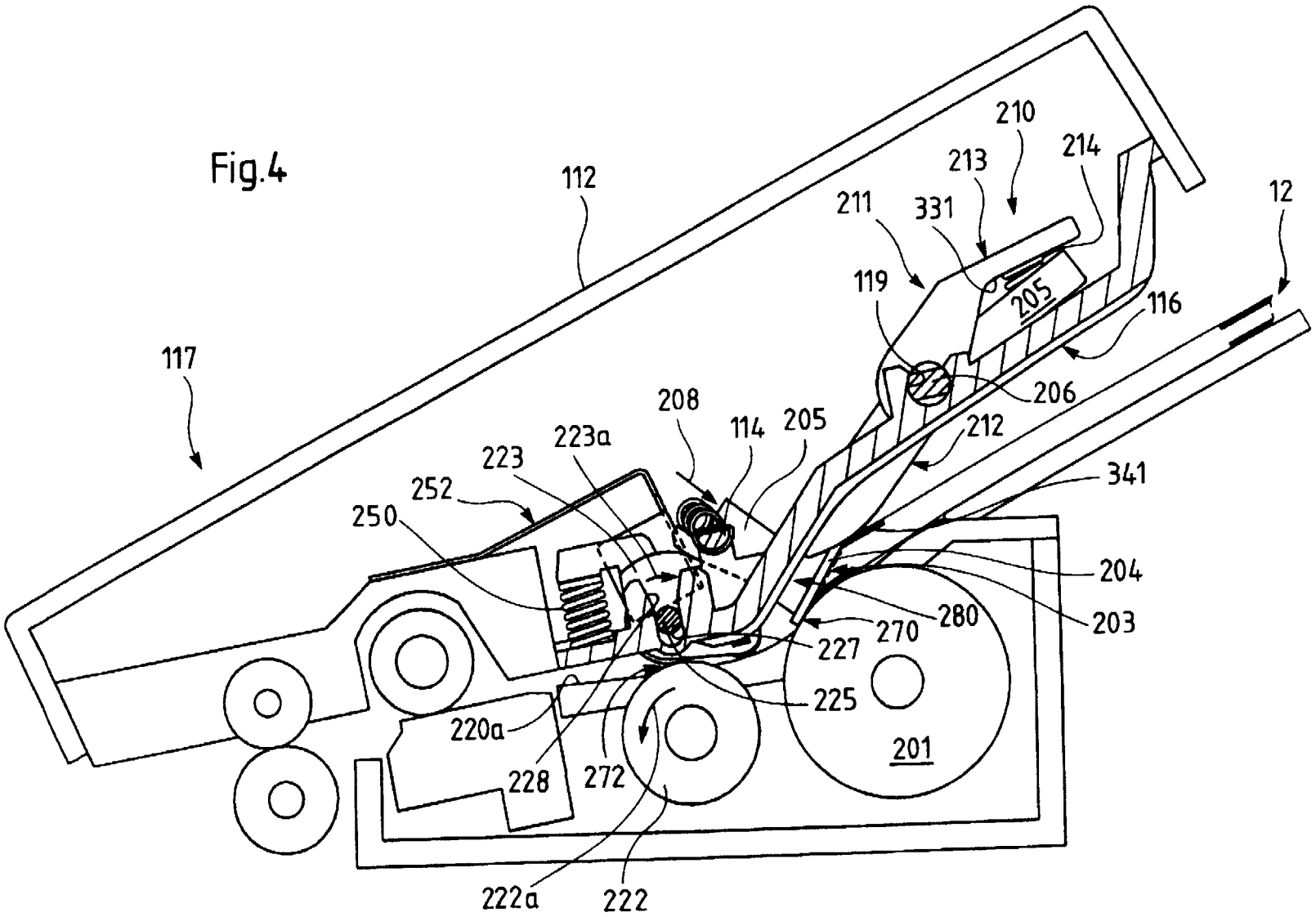
Figure 5:
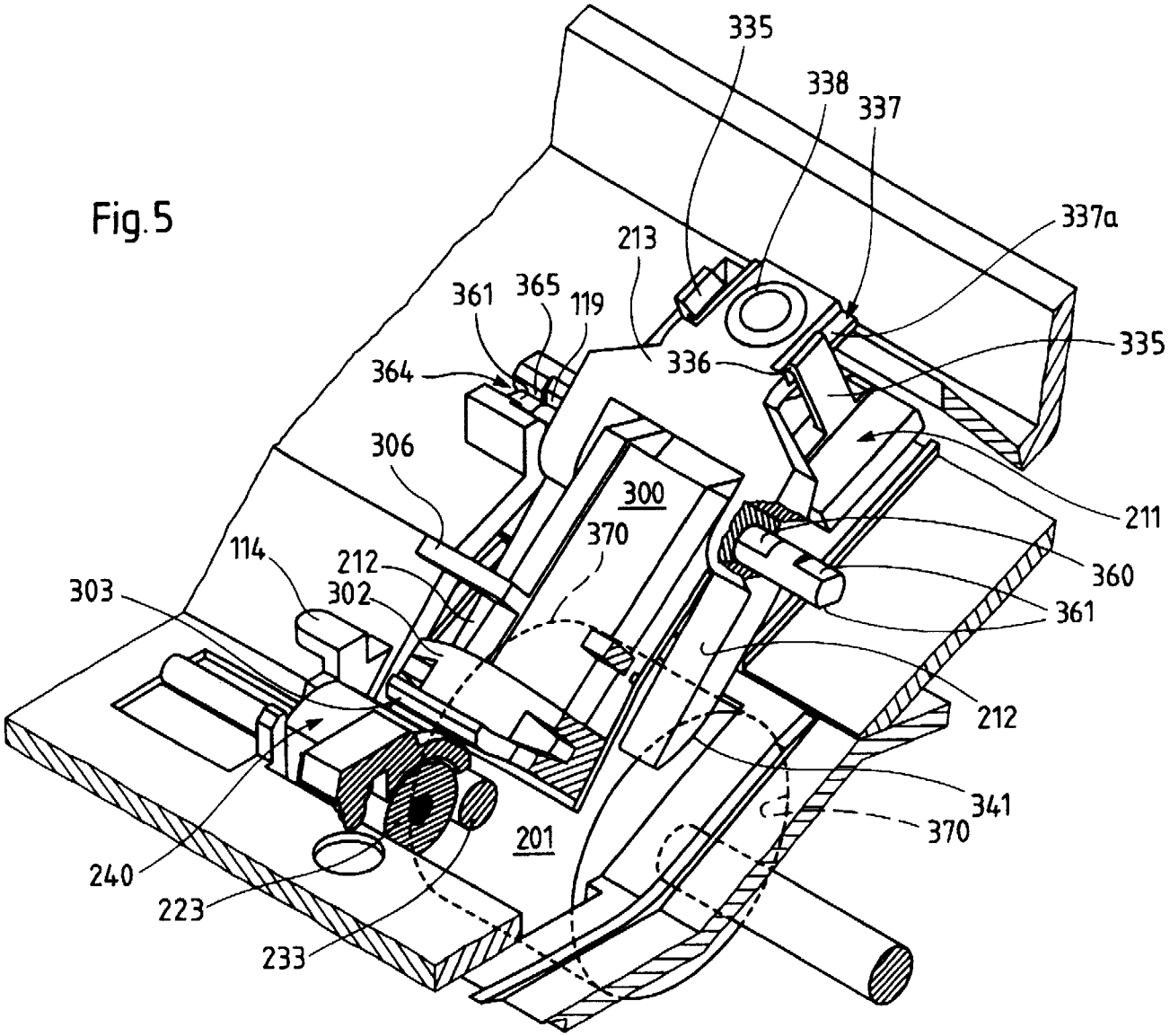
Figure 6:
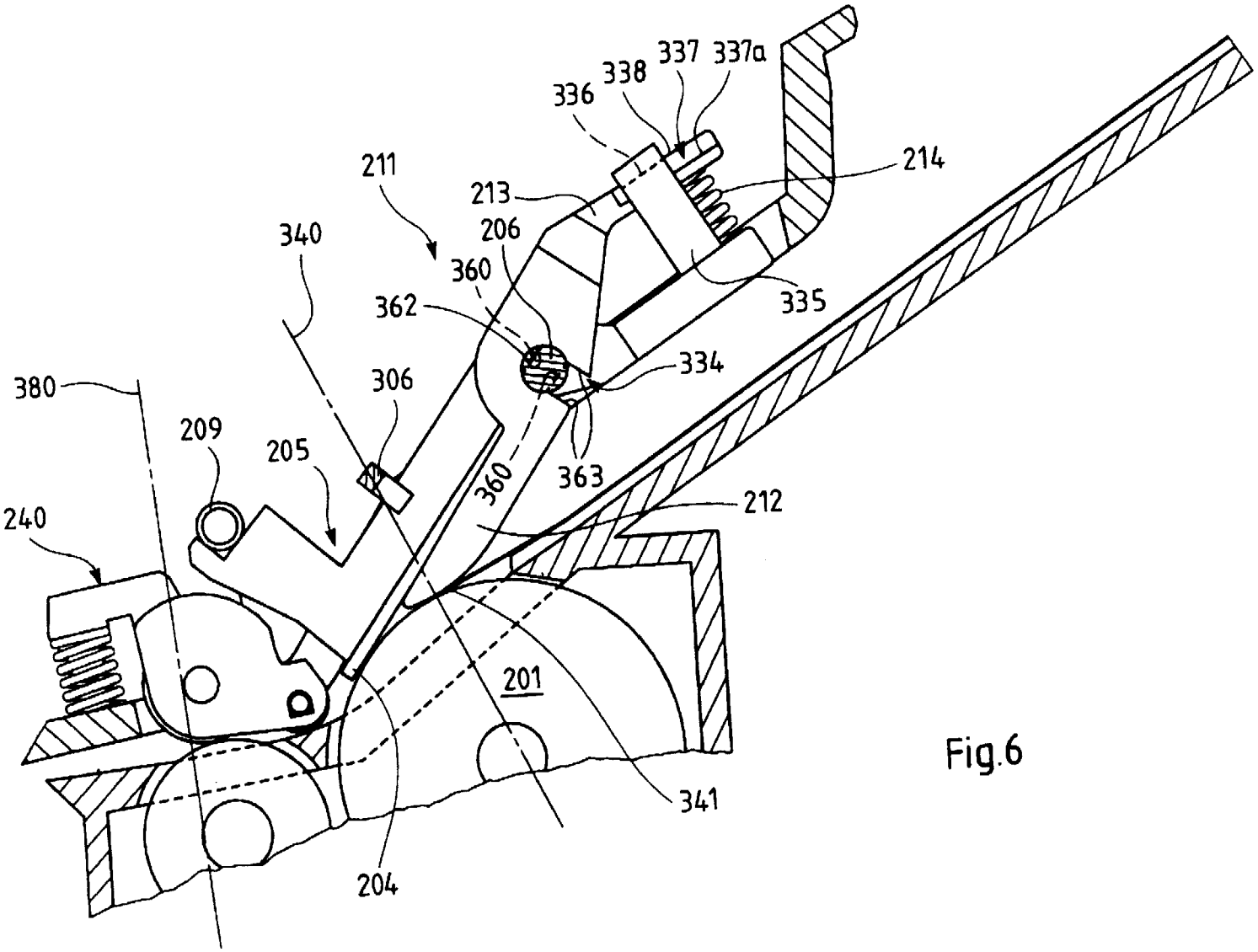
Figure 7:
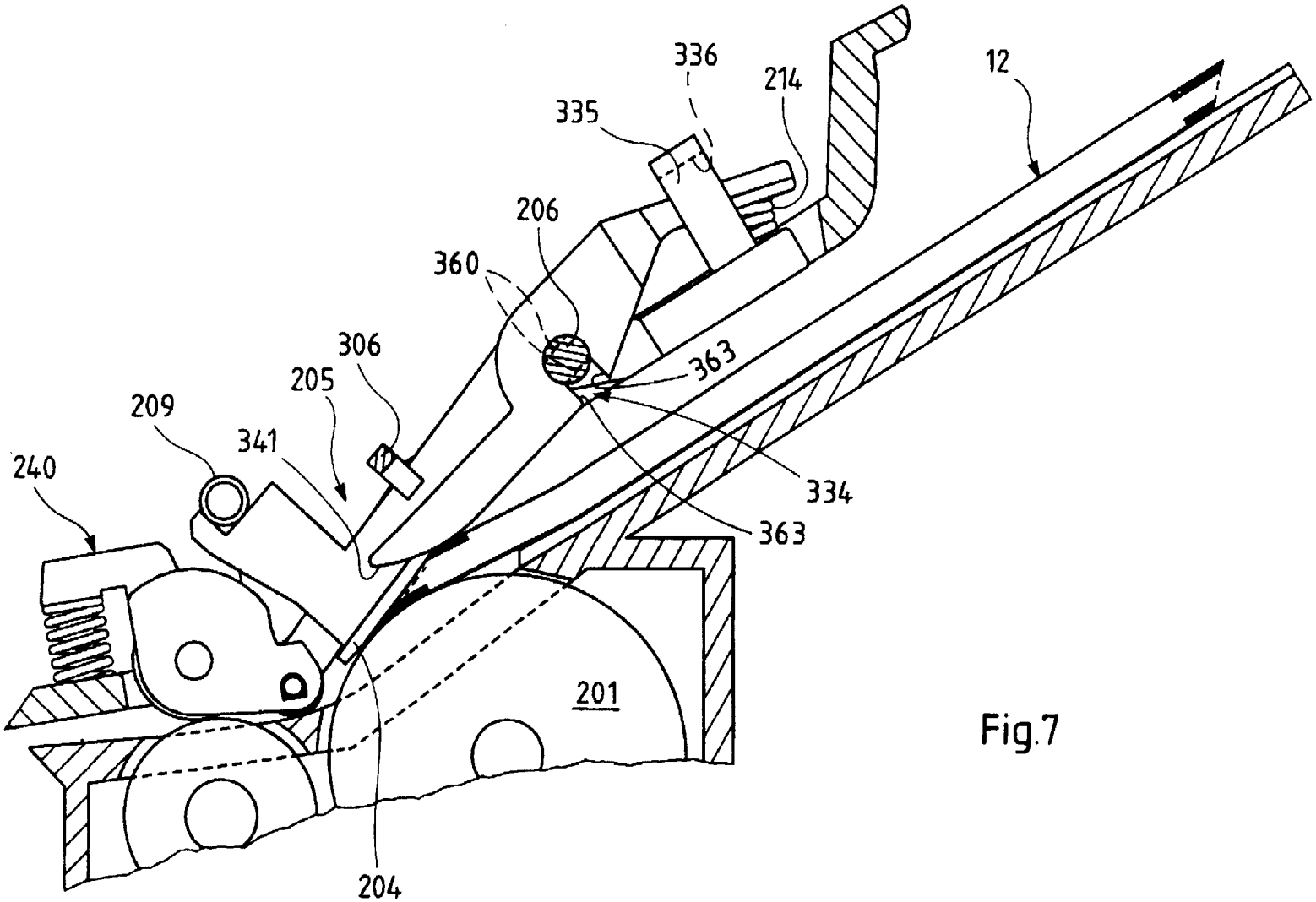

The characteristics and advantages of the invention will, moreover, emerge from the description that follows with reference to the accompanying drawings in which:

FIG. 1 is a highly simplified view in longitudinal section of a facsimile machine having a feeding device in accordance with a preferred embodiment of the present invention, FIG. 2 is an enlarged view of an inset II in FIG. 1, the device being illustrated in elevation and in section along the line 11—11 in FIG. 3, FIG. 3 is a plan view of a part of the device along the arrow III in FIG. 2, FIG. 4 is a view in elevation and in section along the line IV—IV in FIG. 3, FIG. 5 is a simplified perspective view with partial cutaways of a separating and prestressing device used in the feeding device illustrated in FIGS. 1 to 4, in accordance with the invention, and FIGS. 6 and 7 are enlarged views in elevation and in section of the separating and prestressing device, along the line VI—VI in FIG. 3, the feeding device being illustrated with a pile consisting of a single sheet in FIG. 6 and a pile containing several tens of sheets in FIG. 7.

According to the preferred embodiment chosen and depicted in FIG. 1, the feeding device is incorporated in a facsimile machine 100, including in a conventional manner:

- a temporary storage area 101 for documents to be sent, including a plate 102, here inclined with respect to the horizontal, on which the documents are stacked,
- a reading device area 103 essentially having a reading head 104, and a bearing roller 105,
- a printing device for received documents 106 essentially having a printing head 107 and a guide and bearing roller 108,
- a storage tray for paper 109 arranged upstream of a device 110 for conveying the paper to the printing device 106, and
- a sheet feeding device 200 in accordance with the invention designed to transfer one by one the sheets stacked on the support plate 102 to the reading device 103.

In the facsimile machine 100 illustrated in cross section in FIG. 1, part of the reading device (the roller 105) and of the feeding device is arranged in a casing 115 pivoting about an axis shown diagrammatically under the reference numeral 111. On the top of the casing 115 the control panel 112 of the facsimile machine is arranged. In FIG. 1, the casing 115 is illustrated in solid lines in its closed position, in which the facsimile machine is operational. It is illustrated in dotted lines in its open position in which the user can intervene in the event of a paper jam, in order to unblock the facsimile machine.

The casing 115 has, firstly, a frame 116 bearing various elements of the reading and feeding device, and a cover 117 bearing the control panel 112.

Apart from the feeding device 200 which is the object of the present application, and its partial mounting in the frame 116, all the other devices and arrangements described briefly in relation to FIG. 1 are conventional and as well known to the man skilled in the art. These devices and arrangements will consequently not be described in greater detail here. It should, however, be noted that the storage tray 109 known in the state of the art can be replaced by the one which is the object of French patent applications Nos 94.12993, 94.12994 and 94.12995 filed on Oct. 28,1994, the descriptions of which are incorporated herein by reference.

FIGS. 2 to 7 enable the feeding device in accordance with the preferred embodiment of the present invention to be better understood.

FIG. 2 is an enlargement of the inset II in FIG. 1. It illustrates in greater detail the feeding device 200 and the arrangement of the casing 115.

The feeding device includes, in addition to the storage plate 102, a separating drive roller 201, which is arranged so as to be in contact with the sheet at the bottom of a pile of sheets (in this instance of documents to be sent) disposed on the plate 102. The pile of sheets has been depicted under the reference numeral 12. The roller 201 is rotated in the direction shown by the arrow 202 by a geared motor drive device, not shown in this figure and having a conventional structure.

The device 200 also has a friction device 203 borne by the frame 116 and arranged in an opening 118 in the latter. This friction device 203 forms with the roller 201 a separation device, as mentioned above.

In accordance with the preferred embodiment of the invention, the friction device has a rubber blade 204 mounted on a movable support 205, itself mounted so as to rotate by means of a shaft 206 on bearings 119 on the frame 116 (see FIGS. 3, 4 and 5, in which a single bearing is depicted).

The movable support 205 has a body 300 which is visible in longitudinal section in FIG. 2 and which is L-shaped overall. The large arm of the L is substantially arched, and has a notch 301 designed to house the rubber blade 204.

The small arm of the L of the body 300 has, in its central part, a substantially thick area, so as to form a surface 302 from which a stop 303 holding a spring 209 is raised.

The spring 209 biases the movable support 205 towards the roller 201, in the direction of an arrow 208. It is attached to the frame 116 by means of hooks 114 (see FIGS. 3, 4 and 5).

The feeding device also includes two downstream drive rollers, one lower 222, the other upper 223, whose directions of rotation are respectively shown diagrammatically by the arrows **222*a*, 223*a*. They are designed to drive the sheet towards the exit from the feeding device 200**.

The feeding device 200 also includes guide surfaces for the sheets, upper 280 and lower **220*a*, and a bearing roller 233 able to move in the plane of the angle formed by the transfer path which here extends from the area of contact 270 between the roller 201 and the blade 204 as far as the area of contact 272 between the rollers 222 and 223**.

In the preferred embodiment described here, the roller 233 is mounted on a movable compensation lever 240 whose axis of rotation is common with the axis of the upper downstream roller 223.

A spring 250 is also arranged so as to be compressed between the lever 240 and a bearing surface 251 fixed to the frame 116, and designed to bias the movable bearing roller 233 towards the lower guide surface **220*a***.

All the guide means, and in particular the movable bearing roller 233 and the compensation lever 240, are the object of French patent application No 9501162 whose content is incorporated herein by reference. Reference should therefore be made to this patent application for a more complete description of these means.

The body 300 is produced of a single piece with two journals forming the rotation shaft 206. In this embodiment, the body 300 is produced from plastic, the rubber blade 204 being bonded to the latter.

It will also be noted that the body 300 has, moulded in one piece with it, two retaining arms 306, designed to limit, in cooperation with the frame 116, the angular travel of the movable support 205 when the casing 115 is in the open position (dotted lines) in FIG. 1 (see also FIGS. 3 and 5).

Furthermore, two leaf springs 252 are provided, to exert a downward pressure on a shaft 225, forming the common rotation axis of the movable compensation lever 240 and upper downstream roller 223, and mounted so as to be movable in translation in notches 228 in bearings 227.

The feeding device 200 has, moreover, a prestressing device 210 designed to compress the pile of sheets 12 so as to ensure contact between the bottom sheet and the roller 201. In accordance with this preferred embodiment of the invention, the prestressing device 210 includes, for this purpose, a lever 211 arranged so as to pivot about the shaft 206 so that the movable support 205 and the lever 211 have a common axis of rotation.

The lever 211 includes, on the one hand, a pair of lateral prestressing arms 212 and, on the other hand, an actuation arm 213. The actuation arm 213 here has a housing 332 designed to house the top end of a compression spring 214, which is designed to bias the prestressing arms 212 towards the roller 201. The other end of the spring 214 is here housed in a housing 305 formed in the right-hand end of the body 300.

The body 300 has two inverted L-shaped arms 335 designed to limit the angular travel of the lever 211 with respect to the movable support 205. To this end, the top surface 338 of the end of the actuation arm 213 of the lever 211 has a notch 337 arranged on each of its lateral sides. The bottom surface 337*a* of the notch 337 is designed to cooperate with the bottom face 336 of the horizontal arm of the L of each of the arms 335 (see notably FIGS. 5, 6 and 7). Thus, when the casing 115 is brought to its open position (that illustrated in dotted lines in FIG. 1), the compression spring 214 slackens: the relative travel of the lever 211 with respect to the movable support 205 is therefore limited by cooperation between the surfaces 336 and 337*a*.

The arrangement of the journals 206, which, in this preferred embodiment, enables the lever 211 and movable support 205 to pivot about a common axis, will now be described.

It should, first of all, be stated that the journals 206 are moulded in one piece with the body 300. They are aligned along a single axis, and each has a symmetrical structure. Only one of these journals will, consequently, be described.

The journals 206 are designed to be engaged, on the one hand, in a bearing 362, provided in each of the lateral arms 212, in order to allow the relative pivoting of the lever 211 and movable support 205, and, on the other hand, in the bearings 199 of the frame 116, in order to enable the assembly to pivot with respect to the said frame. The arrangement of the bearings 362 and 119, in cooperation with the arrangement of the journals 206 on the one hand enables the journals to be mounted in the said bearings and on the other hand enables them to be held in place subsequently.

In this preferred embodiment, each journal 206 has two pairs 360, 361 of diametrically opposite flats, designed to enable the journal to be mounted in the bearings concerned. In FIG. 5, it will be observed that the end flats 361 are circumferentially offset with respect to the intermediate flats 360, the end flats 361 being designed to enable the journal 206 to be mounted on the corresponding bearing 119, and the intermediate flats 360 being designed to enable the journal 206 to be mounted in the corresponding bearing 362.

Each bearing 362 opens into an insertion groove 334 having two parallel opposite faces 363 separated by a distance substantially greater than that separating the intermediate flats 360 (FIG. 6).

In order to raise the lever 211 on the movable support 205, the insertion grooves 334 are aligned with the intermediate flats 360, which enables the journals to be engaged in the bearing 362. A subsequent relative rotation of the two components into the position where they are depicted in FIG. 6, that is to say with the flats 360 having a very different orientation from those of the faces 363, then prevents the journal from escaping from the bearing 362, since the distance separating the faces 363 of the insertion groove 334 is less than the diameter of the journal 206.

A similar arrangement enables each journal 206 to be mounted in the corresponding bearing 119.

Each of the bearings 119 opens out into an insertion groove 364 with two parallel opposite faces, only one of which 365 is visible in FIG. 5. These faces are separated by a distance substantially greater than that separating the end flats 361. It will, moreover, be observed from FIG. 5 that, when the components adopt the position illustrated in this figure, the orientation of the flats 361 is substantially different from that of the faces 365 of the insertion groove 364.

The assembly formed by the lever 211 and movable support 205 is assembled by presenting the flats 361 of the journals 206 in an orientation parallel to that of the insertion grooves 364, so as to engage the former in the latter. A relative rotation of the various components, to bring them into the position in which they are depicted in FIG. 5, then enables the journals 206 to be prevented from escaping from the bearings 119, as illustrated notably in FIG. 4.

It will thus be observed that the arrangement of the journals 206 and of the various bearings and insertion grooves enables the components to be assembled as illustrated in the figures, in such a way that, in accordance with the preferred embodiment of the invention, the movable support 205 and the lever 211 pivot about a common axis, namely that of the journals 206.

In accordance with another characteristic of the present invention, advantageously implemented in the preferred embodiment chosen and depicted in the figures, the lateral prestressing arms 212 are arranged so as to bias the pile of sheets 12 in the vicinity of the lateral ends 370 of the drive roller 201, above the latter.

In this preferred embodiment, it will be observed, from FIG. 5, that the lateral arm 212, arranged on the right-hand side of the figure, is biased towards the roller 201, and projects substantially beyond the lateral end 370 of the latter. In reality, it overlaps the lateral end of the roller 201 over half its width. A symmetrical arrangement is provided at the other end of the roller 201, as regards the second prestressing arm 212 (barely visible in FIG. 5; see also FIG. 3).

This arrangement enables the cooperation between the drive roller 201 and the lateral prestressing arms 212 to be improved, since the prestressing force generated by the compression spring 214 thus acts in the vicinity of the ends of the roller, that is to say at the point where the contact between the roller and the pile of sheets is natural (owing to the substantially arched nature of the pile of sheets in the transversal direction).

In accordance with the normal practice for facsimile machines, a double system for detecting the front end of sheets, designed to facilitate loading, is also provided. This device, whose structure is conventional, will not be described in detail here. The two positions for detection of sheets are shown diagrammatically by axes in dot-and-dash lines illustrated under the references 340 and 380 (see FIG. 6).

The operation of the device will now be described, with reference to FIGS. 6 and 7.

FIG. 6 illustrates the case where only a small number of documents to be sent, or even only one, is loaded into the facsimile machine. FIG. 7 illustrates the converse case, where a large number of documents (for example around thirty) are loaded into the facsimile machine.

When the facsimile machine is loaded with a small number of documents, the device according to the preferred embodiment of the invention operates as follows.

First of all, it will be observed that, in elevation, the surface 341 of the left-hand end of the prestressing arms 212 is heavily rounded, this surface being tangential to the drive roller 201.

Consequently, when a small number of documents, or only one, is introduced into the storage area 101 of the facsimile machine, these documents slide naturally as far as the area of contact between the surface 341, that is to say the end of the prestressing arms, and the drive roller 201. The document or documents are then naturally gripped between the prestressing arms 212 and the roller 201, without the said arms 212 needing to be raised counter to the force generated by the spring 214.

The detection axis 340 is situated very substantially towards the right with respect to the area of contact between the surface 341 and the roller 201. Consequently, when the document or documents are introduced, the front end of the latter cuts the axis 340, which on the one hand triggers an audible signal, to inform the user that the documents are loaded correctly and, on the other hand, after a certain pause, rotates the roller 201, to bring these documents into contact with the rubber blade 204. The friction device formed by the blade 204 then fulfils its function by allowing only the bottom sheet to pass. When the front end of the latter cuts the axis 380, the position of this end is then known for certain by the logic of the facsimile machine (which is here of conventional structure), and this logic can then, in a conventional manner, drive this sheet in order for it to be read by the device 103. It will, moreover, be noted that the operation of driving the document towards the device 103 is also described in French patent application No 9501162 mentioned above.

It will be observed that the spring 214, which biases the surface 341 towards the roller 201, exerts, through the lever 211, a pressure such that the various friction forces generated by the drive roller 201, the rubber blade 204 and the prestressing arms 212 are such that only the sheet at the bottom of the pile (or the single document) is driven towards the reading device 103, during the rotation of the drive roller 201.

When a large pile of documents (for example thirty) is loaded, this pile has, by its very nature, a certain rigidity and a certain thickness, so that the user, in loading the documents, exerts on the lateral prestressing arms 212 of the lever 211 a certain force, which tends to cause them to pivot upwards. When the front end of the sheets cuts the axis 340, an audible signal sounds to alert the user and, after a certain pause, the drive roller 201 starts up to bring all the front ends of the sheets into contact with the rubber blade 204, as illustrated in FIG. 7.

The sheets are then driven one by one towards the reading device 103 by the roller 201, as described above.

It will be observed that, in this case, the spring 214 is then Substantially compressed, as illustrated in FIG. 7. This spring will be chosen by those skilled in the art so that the prestressing arms exert a force on the pile of sheets 12, so that the first sheet receives a force tending to push it against the roller 201, of the same order as that received by the single sheet in contact with the roller 201, as illustrated in FIG. 6.

In other words, the characteristics of the spring 214 are determined so that a sufficient force is exerted on the first sheet through the pile 12, given the "force damping" due to various tensions present between the sheets in the pile 12, notably because of the presence of air, the texture of the sheets and their natural elasticity and, in a general manner, the influence of the environment.

In comparison with the prior art analyzed in the preamble of the present application, in the range of travel of the end 341 of the prestressing arms 212 depicted by FIGS. 6 and 7, the spring 214 exerts, through the lever 211, a force varying in a substantially linear manner. Thus the characteristics of the compression spring illustrated under the reference numeral 214 are easier for those skilled in the art to determine on a case by case basis than those of the leaf spring in the prior art.

Moreover, experience shows that the range of travel of the prestressing device is significantly greater, which allows a larger pile of sheets to be loaded, while avoiding the risks of absence of feeding or multiple feeding as the pile of documents diminishes.

Furthermore, the presence of a rounded surface, such as the surface 341 of the ends of the prestressing arms 212, guarantees a pushing area for the sheet at the bottom of the pile 12 against the roller 201 which remains practically constant, whether the pile contains a small number of sheets or several tens thereof.

Finally, it will be observed that, owing to the arrangement of the prestressing arms 212 in the vicinity of the ends of the roller 201, the said arms project substantially from the ends in the embodiment chosen and depicted, the prestressing force which is exerted through the pile of sheets 12 on the ends of the roller 201 has the effect of substantially modifying the curvature thereof, owing to a flattening of the roller at these ends. Consequently, the apparent radius of the roller 201 increases and the driving effect on the sheet at the bottom of the pile 12 is substantially the same as if the latter were subjected to a drive roller having a substantially greater radius than that which it had in reality. Thus the efficacy of the drive roller, and consequently the separating power of the device described in the present application, is increased, in comparison with the prior art.

The present invention is not, of course, limited in any way to the chosen embodiments depicted, but quite on the contrary encompasses any variant within the reach of the man skilled in the art.

In particular, in the preferred embodiment described above in relation to the figures, the friction device has a friction blade 204, produced in this instance from rubber. Those skilled in the art may, of course, replace this friction device with any other friction device within their reach, for example a roller rotating so that the tangential speeds of this roller and of the drive roller 201, in their area of contact, are in opposite directions.

Moreover, the lever 211, pivoting so as to rotate on the journals 206 and including a pair of prestressing arms 212, as described with reference to the preferred embodiment, can be replaced by a movable bearing means having at least one prestressing surface, such as that bearing the reference numeral 341 above, the elastic means, formed above by the spring 214, then acting on the movable bearing means to bias the prestressing surface towards the drive roller 201.

Furthermore, this bearing means can be assembled with the bearing means having mobility not only in rotation, but also in translation, or even both, in the manner described for example above for the movable compensation lever 240.

Similarly, in other embodiments, the movable support 205, instead of being mounted so as to pivot, as has just been described, can also be mounted so as to be able to move in translation, or even able to move both in translation and in rotation.

We claim:

1. Sheet feeding device (100) designed to transfer, one by one, along a sheet transfer path, sheets forming part of a pile (12) to a processing device for the sheets, and having a temporary storage area (101) for the pile of sheets;

a drive roller (201) arranged so as to be in contact with a first sheet disposed at one of the ends of the pile;

a separating and prestressing device (203, 210) disposed opposite the drive roller and having a movable support arranged opposite said drive roller and bearing a friction device to generate at least on the first sheet, friction in a direction substantially opposite to the direction in which the first sheet is driven by said drive roller, a movable prestressing means arranged opposite said drive roller and having at least one prestressing surface designed to contact the pile of sheets and exert a pressure force thereon so as to urge said first sheet towards the drive roller, at a location along the sheet transfer path upstream the location where said friction is generated on said first sheet by said friction device and elastic means acting on said movable prestressing means in order to bias said at least one prestressing surface towards the drive roller; and means for mounting said separating and prestressing device on said sheet feeding device with said support and said prestressing means being movable on said sheet feeding device and with respect to each other;

said support and said prestressing means thereby cooperating to separate said first sheet from the rest of the pile.

2. Sheet feeding device (100) designed to transfer, one by one, along a sheet transfer path, sheets forming part of a pile (12) to a processing device for the sheets, and having a temporary storage area (101) for the pile of sheets;

a drive roller (201) arranged so as to be contactable with a first sheet disposed at one of the ends of the pile; p1 a separating and prestressing device (203, 210) disposed opposite the drive roller and having a movable support arranged opposite said drive roller and bearing a friction device to generate at least on the first sheet, friction in a direction substantially opposite to the direction in which the first sheet is driven by said drive roller, a lever arranged opposite said drive roller and having a pair of lateral prestressing arms designed to contact the pile of sheets and exert a pressure force thereon so as to urge said first sheet towards the drive roller, at a location along the sheet transfer path upstream the location where said friction is generated on said first sheet by said friction device, and elastic means acting on said lever in order to bias said pair of lateral prestressing arms towards the drive roller; and means for mounting said separating and prestressing device on said sheet feeding device with said support and said lever being movable on said sheet feeding device and with respect to each other;

said support and said prestressing arms thereby cooperating to separate said first sheet from the rest of the pile.

3. Feeding device according to claim 2, characterised in that the movable support (205) and the lever (211 ) pivot about a common axis.

4. Feeding device according to any one of claims 1 to 3, characterised in that the friction device has a separating blade (204).

5. Feeding device according to claim 1, characterised in that the movable prestressing means is arranged so as to act on the pile of sheets in the vicinity of the lateral ends of the drive roller (201) and above the latter.

6. Feeding device according to any one of claims 2 to 3, characterised in that the lateral prestressing arms are arranged so as to act on the pile of sheets in the vicinity of the lateral ends of the drive roller (201) and above the latter.

7. Feeding device according to any one of claims 1 and 5, characterised in that the prestressing surface (341) is rounded at the end making contact with the drive roller (201).

8. Feeding device according to any one of claims 2 or 3, characterised in that the said prestressing arms (212) each have a prestressing surface rounded at the end (341) making contact with the drive roller (201).

9. Feeding device according to any one of claims 1 to 3, characterised in that it also has elastic means (209) for biasing the movable support (205) towards the drive roller (201).

10. An image forming apparatus comprising a sheet feeding device designed to transfer, one by one, along a sheet transfer path, sheets forming part of a pile to a processing device for the sheets, and having a temporary storage area for the pile of sheets;

a drive roller arranged so as to be contactable with a first sheet disposed at one of the ends of the pile;

a separating and prestressing device disposed opposite the drive roller and having a movable support arranged opposite said drive roller and bearing a friction device to generate, at least one the first sheet, friction in a direction substantially opposite to the direction in which the first sheet is driven by said drive roller, a movable prestressing means arranged opposite said drive roller and having at least one prestressing surface designed to contact the pile of sheets and exert a pressure force thereon so as to urge said first sheet towards the drive roller, at a location along the sheet transfer path upstream the location where said friction is generated on said first sheet by said friction device, and elastic means acting on said movable prestressing means in order to bias said at least one prestressing surface towards the drive roller; and means for mounting said separating and prestressing device on said sheet feeding device with said support and said prestressing means being movable on said sheet feeding device and with respect to each other;

said support and said prestressing means thereby cooperating to separate said first sheet from the rest of the pile; and said image forming apparatus further comprising image forming means for forming an image on the fed sheet.

11. An image forming device comprising a sheet feeding device designed to transfer, one by one, along a sheet transfer path, sheets forming part of a pile to a processing device for the sheets, and having a temporary storage area for the pile of sheets;

a drive roller arranged so as to be contactable with a first sheet disposed at one of the ends of the pile;

a separating and prestressing device disposed opposite the drive roller and having a movable support arranged opposite said drive roller and bearing a friction device to generate, at least on the first sheet, friction in a direction substantially opposite to the direction in which the first sheet is driven by said drive roller, a lever arranged opposite said drive roller and having a pair of lateral prestressing arms designed to contact the pile of sheets and exert a pressure force thereon so as to urge said first sheet towards the drive roller, at a location along the sheet transfer path upstream the location where said friction is generated on said first sheet by said friction device, and elastic means acting on said lever in order to bias said pair of lateral prestressing arms towards the driver roller; and means for mounting said separating and prestressing device on said sheet feeding device with said support and said lever being movable on said sheet feeding device and with respect to each other;

said support and said prestressing arms thereby cooperating to separate said first sheet from the rest of the pile; and image forming means for forming an image on the fed sheet.

12. An image forming apparatus according to claim 11, characterized in that the movable support and the lever pivot about a common axis.

13. An image forming apparatus according to any one of claims 10 to 12, characterized in that the friction device has a separating blade.

14. An image forming apparatus according to claim 10, characterized in that the movable prestressing means is arranged so as to act on the pile of sheets in the vicinity of the lateral ends of the drive roller and above the latter.

15. An image forming apparatus according to any one of claims 11 to 12, characterized in that the lateral prestressing arms are arranged so as to act on the pile of sheets in the vicinity of the lateral ends of the drive roller and above the latter.

16. An image forming apparatus according to any one of claims 10 and 14, characterized in that the prestressing surface is rounded at the end making contact with the drive roller.

17. An image forming apparatus according to any one of claims 11 or 12, characterized in that the said prestressing arms each have a prestressing surface rounded at the end making contact with the drive roller.

18. An image forming apparatus according to claims 10 to 12, characterized in that it also has elastic means for biasing the movable support towards the drive roller.

* * * * *

UNITED STATES PATENT AND TRADEMARK OFFICE

CERTIFICATE OF CORRECTION

PATENT NO. : 5,718,424
DATED : February 17, 1998
INVENTOR(S) : Noboru NAKATANI, et al.

It is certified that error appears in the above-identified patent and that said Letters Patent is hereby corrected as shown below:

Column 4, line 57, delete "11-11" and insert therefor --II-II--.

Column 7, line 28, delete "199" and insert therefor --119--.

Column 9, line 40, delete "Substantially" and insert therefor --substantially--.

Column 10, line 55, delete "in contact" and insert therefor --contactable--.

Column 11, line 5, after "device", insert a comma (",");
Line 19, delete "p1".

Column 12, line 11, delete "one" and insert therefor --on--;
Line 36, delete "device" and insert therefor --apparatus--;
Line 58, delete "driver" and insert therefor --drive--.

Column 13, line 1, after "forming", first occurrence, insert --apparatus further comprising image forming--.

Signed and Sealed this

Twenty-fifth Day of August, 1998

Bruce Lehman

*Attest:*

BRUCE LEHMAN

*Attesting Officer*

*Commissioner of Patents and Trademarks*